US005456030A

United States Patent [19]

Barone et al.

[11] Patent Number: 5,456,030

[45] Date of Patent: Oct. 10, 1995

[54] QUICK COUPLER FOR HEAVY EQUIPMENT IMPLEMENTS

[75] Inventors: Michael Barone, Arvada; Frank Barone, Morrison, both of Colo.

[73] Assignee: Barone, Inc., Arvada, Colo.

[21] Appl. No.: 359,402

[22] Filed: Dec. 20, 1994

Related U.S. Application Data

[63] Continuation of Ser. No. 79,998, Jun. 21, 1993, abandoned.

[51] Int. Cl.[6] ..... E02F 3/28

[52] U.S. Cl. ..... 37/468; 414/723; 172/272

[58] Field of Search ..... 172/272, 275; 37/468, 231, 403; 414/723, 724, 912; 403/322, 325

[56] References Cited

U.S. PATENT DOCUMENTS

| | | | |
|---|---|---|---|
| 4,355,945 | 10/1982 | Pilch | 414/703 |
| 4,397,604 | 8/1983 | McCain | 414/723 |
| 4,436,477 | 3/1984 | Lenertz et al. | 414/723 |
| 4,726,731 | 2/1988 | Jones | 414/723 |
| 4,810,162 | 3/1989 | Foster | 414/723 |
| 5,082,389 | 1/1992 | Balemi | 403/322 |
| 5,179,794 | 1/1993 | Ballinger | 37/468 |
| 5,332,353 | 7/1994 | Arnold | 414/723 |

FOREIGN PATENT DOCUMENTS

| | | | |
|---|---|---|---|
| 4-83023 | 3/1992 | Japan | 37/468 |
| 604911 | 4/1978 | U.S.S.R. | 37/468 |
| 88/02421 | 4/1988 | WIPO | 37/468 |

*Primary Examiner*—Randolph A. Reese
*Assistant Examiner*—Spencer Warnick
*Attorney, Agent, or Firm*—Rothgerber, Appel, Powers & Johnson

[57] ABSTRACT

A coupling device or "quick coupler" which permits the rapid connecting and disconnecting of implements to an earth-working device having a hoe boom comprising at least one primary lifting arm fitted for a hinge pin and a "curling linkage" mechanism having either two idler links and a power link, or a single part functioning as an idler link interacting with a power link, either alternative being powered by hydraulic cylinder(s) and fitted for a link pin. The quick coupler has a housing, which can be temporarily attached to the hoe boom using the hinge and link pins or can be built into the hoe boom itself, and which contains a connection for attaching the coupling device to a variety of implements. The effective operating distance or range of motion of the connector can be adjusted so that the coupler can be used with various implements having different center line distances between the hinge and link pins.

12 Claims, 8 Drawing Sheets

QUICK COUPLER FOR HEAVY EQUIPMENT IMPLEMENTS

This is a continuation of U.S. patent application Ser. No. 08/079,998 filed on Jun. 21, 1993.

BACKGROUND OF THE INVENTION

This invention relates generally to the field of earth-working equipment having a "boom" comprised of at least one lift arm and at least one curling linkage for manipulating a tool or implement. More specifically, the invention relates to improved means for rapidly connecting (attaching) and disconnecting implements to earth-working equipment of this type.

Original equipment manufacturers ("OEMs") of earth-working equipment have used various means for attaching implements to a boom. The most common method of attachment is the insertion of two straight pins (one hinge pin and one link pin) through a set of holes in the implement that can be aligned with corresponding holes in the "lift arm" and "curling linkage" as shown in FIGS. 1*a* and 1*b*. This is the typical arrangement currently employed in the industry for connecting earth-working equipment (i.e., an earth-working machine or device) to an implement.

As depicted in FIG. 1*a*, the primary lift arm is fitted for a hinge pin and the curling linkage is fitted for a link pin. The connection-to an implement, as shown in FIG. 1*b*, is accomplished and secured by these pins which are inserted into matching holes on each part of the boom and the implement. These pins permit manipulation and rotation of the implement by the lift arm and curling linkage of the boom. The implement is generally lifted by both pins, and is rotated around the hinge pin by the curling linkage to different positions necessary for performing the work function. As its name suggests, the "lift arm" is utilized to bear the major load of raising and lowering the implement, while the "curling linkage" is utilized to rotate the implement about an axis perpendicular to the lift arm. This arrangement is quite versatile and permits the earth-working equipment to usefully employ a number of different implements, such as a hoe bucket, a soil compaction wheel, a hammer, etc. Collectively, the lift arm and the curling linkage are sometimes referred to as the "boom."

For purposes of this patent "implement" means any ancillary or auxiliary piece of equipment, device or tool which can he attached to a loader/backhoe or excavator for the purpose of doing its work and which is configured for connection to the loader/backhoe or excavator using a hinge and link pin or an equivalent system. The implements must he designed so that they can he attached to or disconnected from the boom in a manner that permits full, effective and proper use of the lift arm and curling linkage. Because these implements must be sturdy and durable to perform their functions properly, and since an implement can typically weigh several thousand pounds, the means of connecting the implement to the boom must also be sturdy, durable and secure. Among other things, the method of connection between the earth-working equipment and the implement should be accomplished in a manner that does not distort the forces applied by its use from those intended to otherwise be applied to the boom and the implement. To do so could result in gradual or sudden failure of these parts and resultant damage to property or people.

While the basic method of attachment shown in FIGS. 1*a* and 1*b* is sturdy and secure and permits proper operation of the implement, the frequent, but necessary, changing of implements create and magnify other deficiencies that make this an impractical, unsafe and expensive method of attachment.

It is desirable, for economic and other reasons, to have as few pieces of major equipment as possible on a job site at any one time. This objective can only be realized if the equipment that is present can be made versatile enough to handle the variety of jobs necessary on a construction site by use of various implements. When a number of implement changes must be made in the course of a work day, aligning holes between boom and implement and driving pins in and out to make the connection using the system shown in FIG. 1 can become a real problem. It takes significant time, effort, patience and brute force to accomplish the connection in this manner. The hydraulics and controls of earth-working equipment are designed for construction purposes, not for making the slight kinds of movements needed to bring the boom into sufficiently close alignment with the implement to accommodate the closely machined tolerances between the pins and the bushings they must slide through. The alignment of the boom and the implement is especially difficult when the implement and the equipment are on uneven surfaces in different vertical planes, which is usually the case. Similarly, the weight of the implement makes it very difficult to manually assist the alignment of the pin holes in the implement with the bushing holes in the lift arm and curling linkage. Thus, even with the mutual efforts of an equipment operator in the cab and another person on the ground, who attempts to manipulate the heavy implement, it is very difficult to effect the connection of the boom and the implement. Even for persons with the skill and experience necessary, it typically takes twenty to thirty minutes to effect a connection. Multiplied by the number of implement changes that may be required during the course of a work day, particularly on smaller jobs, the lost time can be substantial.

In addition to the time and effort that it takes to make a connection by the traditional method, there is a significant risk of injury for the person on the ground who attempts to facilitate the physical connection. The unattached heavy implement can fall over onto the person, and there is a significant danger of crushing fingers and other body parts between the boom and the implement during the connection or disconnection process. Smashed fingers and hands are a common occurrence.

As shown in FIGS. 1*a* and 1*b*, the curling linkage 115 on the boom of most OEM earth-working devices can rotate, i.e., move in relation to the bushing 114 for the hinge pin, to facilitate making the pin-through-hole connections. This arrangement will accommodate different implements with significantly different centerline spacings between their respective hinge and link pins. This does not obviate the problems of connecting and disconnecting an implement to a boom as described previously. In fact, past attempts to find a quick, easy, safe and reliable method of attaching and switching implements have been further frustrated by the failure or unwillingness of the implement manufacturers to standardize on a single spacing between the holes 123 and 133 for the hinge pin and the holes 126 and 136 for the link pins. Although many OEMs of earth-working equipment issue specifications for others to manufacture acceptable tools for their equipment, the specified distance between hinge and link pin varies from OEM to OEM. At the present time, no device is available to solve this problem without either modifying the various implements to a single common spacing between the pins or modifying the implements to a completely different configuration that does not involve pins at all.

The prior art does describe devices that might be generally characterized as "quick couplers". However, none of them solve the foregoing problem of different pin spacings among manufacturers of equipment and implements. For example, U.S. Pat. No. 4,397,604 to McKain describes a device for connecting the boom to an implement with connecting means of the common type shown in FIGS. 1*a* and 1*b*. The McKain patent attempts to make it easier to release the implement from the boom. However, release of the implement is always much easier than connection, because it does not require the aforementioned difficult task of aligning machined pins and bushing holes. The McKain device does not make the more difficult connecting process any easier, and it is not "adjustable" as that term is used herein.

In U.S. Pat. No. 4,545,720 to Cochran et al. a device is shown utilizing over-center locking means in an effort to facilitate the connection between an implement and a loader. This device does not relate to implements having holes to accommodate hinge and link pin connections with a hoe boom of the type shown in FIGS. 1*a* and 1*b* herein. It shows the use of an over-center locking mechanism to facilitate the process of connecting a pair of loader arms to a tool in a totally different arrangement. Specifically, the overcenter locking mechanism of the Cochran device is used to thrust a wedge shaped appendage on the locking linkage through matching holes in the coupler and the implement, which has been modified by the addition of a "lower inclined bucket ramp." This device functions much the same as the deadbolt on a door. It is not used to apply pressure to the hinge and link pins that are the standard means of connecting an implement to a hoe boom. It does not attempt to, nor would it be possible to, utilize the standard hinge and link pin means of connecting an implement to a hoe boom. Accordingly, it also does not address the problem of different pin spacings contained on implements from different manufacturers.

The Cochran device also has another significant problem. The linkage in the over-center locking mechanism in the Cochran device is used to "push" the wedge into place. In mechanical engineering terms, this linkage is used as a "column" or "strut" having compressive loading applied axially. The strength of the Cochran device is in the columnar strength of this linkage; axial loading of forces sufficient to apply enough pressure to securely grab a pair of implement pins would cause this member to fail as a compressive strut, namely to buckle in a direction perpendicular to its axis.

In the present invention the linkage elements of the locking means are used in "tension," thereby utilizing their full tensile strength, which is much greater than that of the same cross sectional-area used as a compressive strut.

U.S. Pat. No. 4,810,162 to Foster traps two pins at a single, precise, fixed centerline distance apart in two recesses. This device has no means of applying pressure on the pins to keep the connection tight and no adjustment to compensate for wear. As a result, the connection may be tight and secure when the equipment is new, but it soon becomes loose and not secure. A minor deviation in pin spacing should make no difference in the function of an implement. However, it makes all the difference in the world with respect to making an implement connection (attachment) secure, a problem that is particularly true with the Foster device. Also, this device depends on the weight of the implement for its release. There is significant risk of injury when the implement is released because a person must be standing directly behind the implement to insert a special tool into the coupler to effect the release.

Finally, in U.S. Pat. No. 5,082,389 to Belemi another connector is shown which can be utilized to connect a boom with an implement having holes for hinge and link pin connectors. This device utilizes an hydraulic cylinder to close the connection around the link pin. It has the same disadvantages that any hydraulic coupler has. If the hoe boom is not already equipped with the necessary extra hydraulics, they must be added at significant cost over and above that of the connector alone. Also, hydraulics are notorious for their tendency to "bleed off" fluid and pressure against the pin is lost, leaving the implement loose and not securely attached. The operator cannot know from the cab of the earth-working equipment whether he has made a secure connection or not. Moreover, the Belemi device is not adjustable for different pin spacings.

SUMMARY OF THE INVENTION

We have now discovered a quick coupling device which meets all of the requirements for effecting a proper connection between the equipment and the implement. The connection utilizes the almost universal OEM hinge and link pin means of connecting an implement to a hoe boom, and the connection permits full, effective and proper operation of the implement. Most importantly, it is quick and easy to effect the connection, the connection is secure during operation, the disconnect procedure is also safe and easy, and the coupler reduces the risk of serious bodily injury. Additionally, the connection is adjustable, permitting the attachment of the OEM's equipment to a variety of implements manufactured by the OEM or any other implement manufacturer, even when the distance between hinge and link pins varies from OEM standards ("OEM standards") (that pin spacing recommended by the manufacturer of the earth-working equipment for optimum performance of his machinery). Further, the quick coupling device is completely independent of any external power source (hydraulic, pneumatic or electrical) either for its operation or for keeping the connection secure. The difference is significant, since the ability to change implements and the security of the connection in the coupler of the present invention are not jeopardized by a loss of "power" (i.e., hydraulic, pneumatic or electrical).

These desirable objects can be achieved utilizing a quick coupler comprising a housing containing means for attaching the coupling device to a piece of earth-working equipment and means for attaching the coupling device to the implement. The means for attaching the coupling device to the earth-working equipment can include a wide variety of means for attaching the connector to the hoe boom. Indeed, the connector can be permanently attached as part of the original OEM boom. The means of attachment to the hoe boom will normally be via the boom's hinge and link pins. The means for attaching the coupling device to the implement includes means for attaching the coupling device to the hinge pin of the implement and means for attaching the coupling device to the link pin of the implement. The means for attaching the coupling device to the hinge pin of the implement comprises a grab hook for engagement with the hinge pin; means for adjusting the effective distance between the means connecting the link and hinge pins so that the quick coupling device can be used with implements made by different manufacturers and having different or varying hinge pin to link pin centerline distances. The means for attaching the coupling device to the link pin of the implement comprises a locking lug for engagement with the link pin; connecting means for connecting the locking lug to a locking device, and a locking device capable of interacting with the connecting means to move the locking lug between an open position and a closed position and to lock the locking lug in the closed position. For purposes of this patent, the terms "locking lug" and "grab hook" are singular, but each can include an assembly comprised of one or more parts, components or sub-assemblies, some or any of which may actually be "hook" shaped or "hook-like" in appearance and character.

Thus, it is an object of the invention to provide a connecting means that can be used to quickly connect the hoe boom of a piece of earth-working equipment to an implement in a secure manner that permits proper operation of the implement.

It is a further object of the invention to provide a connecting means that is versatile, specifically, one that can be utilized to quickly connect earth-working equipment manufactured by one OEM with implements manufactured by that OEM, as well as those of other manufacturers.

Finally, and very importantly, it is an object of the invention to provide a connecting means which has the foregoing advantages and is safe during all phases of use including connection and disconnection of the implement and the performance of its work functions.

Further objects of the invention will be apparent from the description of the invention in the drawings and written specification contained herein including, without limitation, the detailed description of the preferred embodiment.

DESCRIPTION OF THE DRAWINGS

FIG. 1 is an isometric view showing a typical connection between the hoe boom of an earth-working machine and an implement, in this case a bucket, using pins furnished by the OEM.

FIG. 2*a* shows the quick coupler with the adjustable grab hook pivoting about an axis, the handle and locking lug in the locked position, and the implement pins in a position that would be the minimum distance from each other for which the coupler could be effective.

Figure 3:
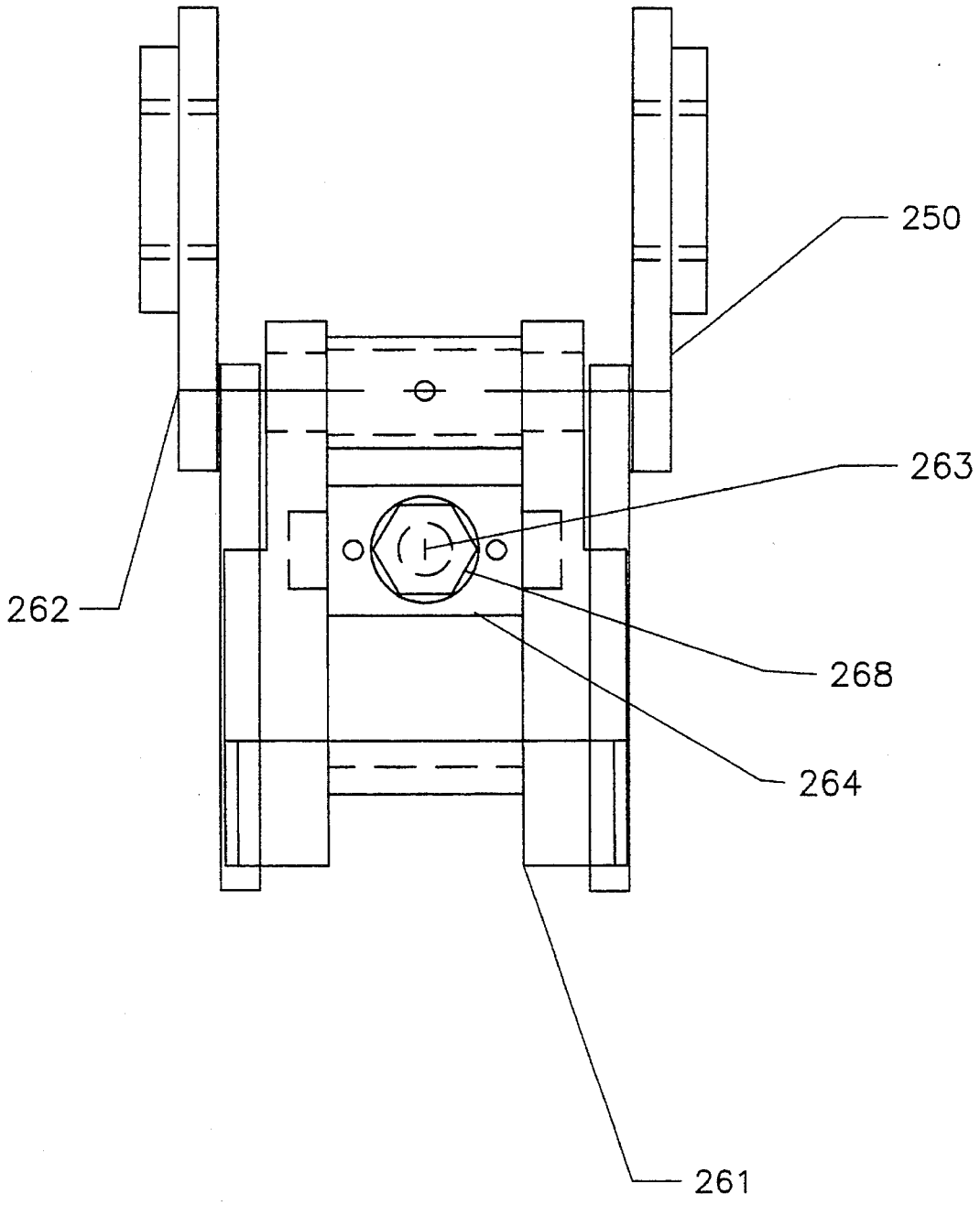
FIG. 3 is an end view of the quick coupler shown in side views 2*a*, 2*b*, and 2*c*. The view is from the right-end of the devices shown in FIGS. 2*a*, 2*b* and 2*c* looking to the left.
Figure 4:
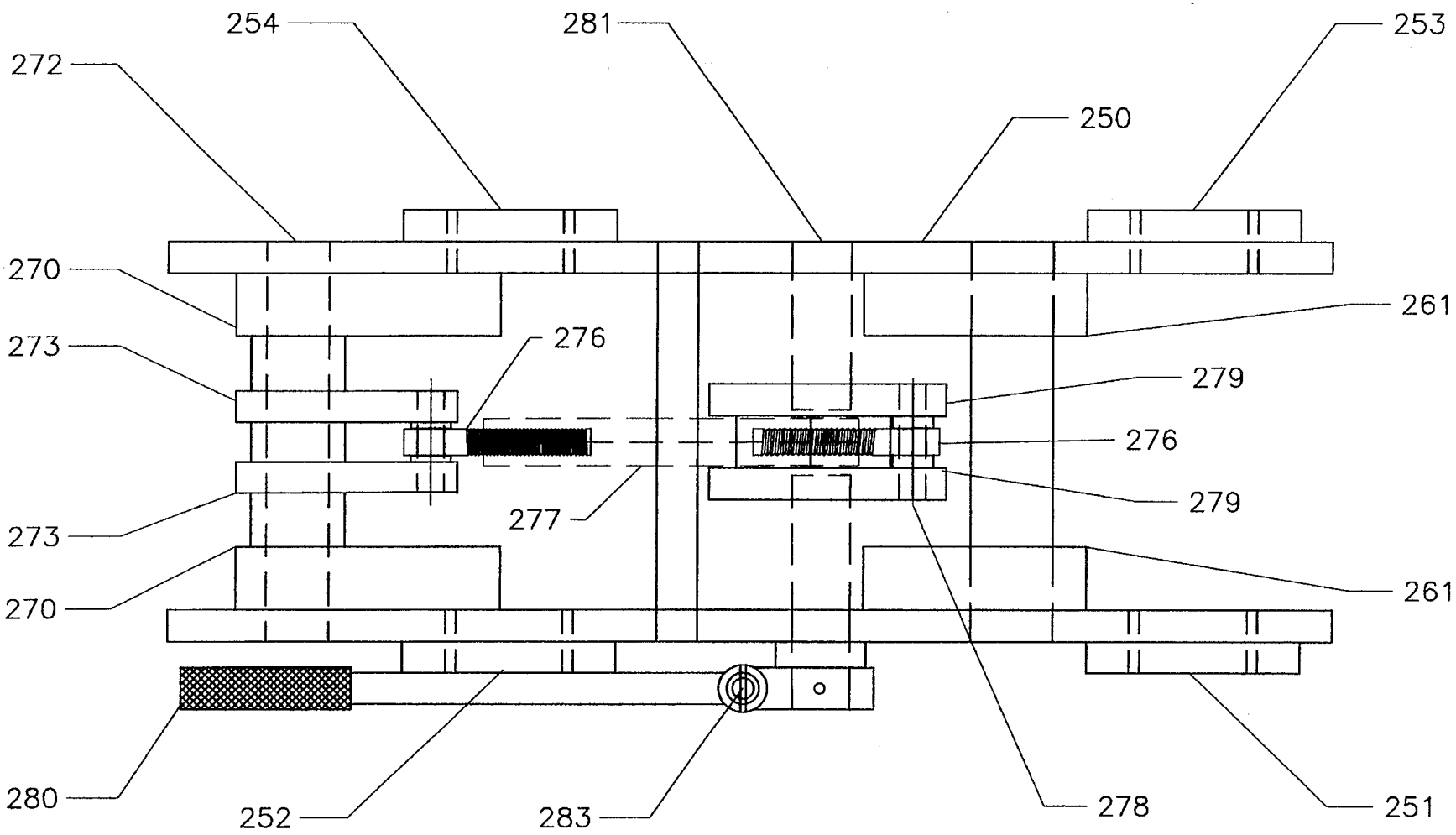
FIG. 4 is a plan view of the quick coupler shown in side views 2*a*, 2*b*, and 2*c*, looking down from above.

The drawings are not to scale, but are intended merely to depict the arrangement of parts in two of the configurations that are suitable for implementing the present invention. Identical parts appearing in the various drawings are given the same double digit numbers, preceded by a "1" in the case of FIGS. 1*a* and 1*b* (i.e., the existing conventional connecting means), "2" in the case of FIGS. 2 through 4 (e.g., the preferred embodiment of this invention), and "3" in the case of FIGS. 5 and 6 (i.e., an alternative embodiment of this invention). The drawings utilize dashed lines to show items that would otherwise be hidden from an external view of the equipment.

DESCRIPTION OF THE INVENTION AND THE PREFERRED EMBODIMENT

We have now discovered a quick coupling device that accomplishes all of the foregoing objectives.

Figure 1B:
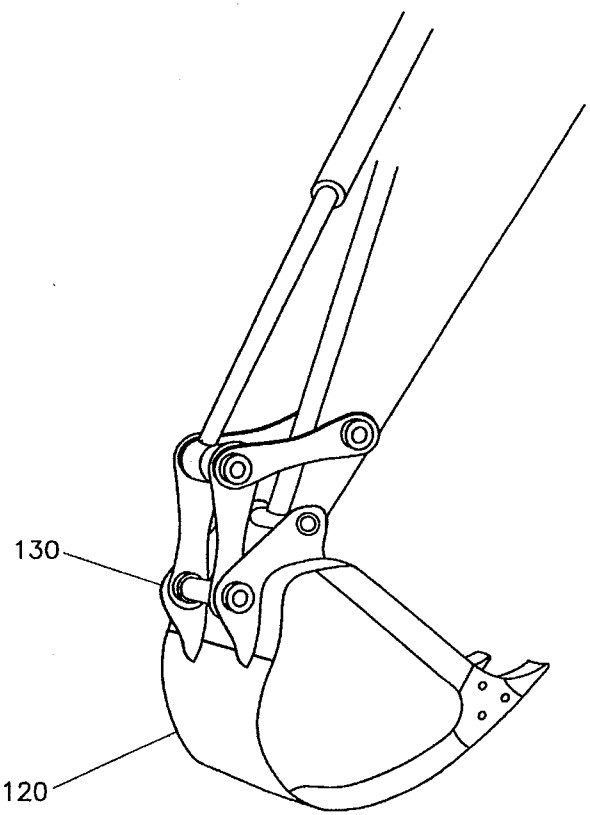
PRIOR ART FIG. 1b
FIG. 1*b* shows the boom and implement connected in the manner conventionally employed in the industry prior to this invention.
Figure 1A:
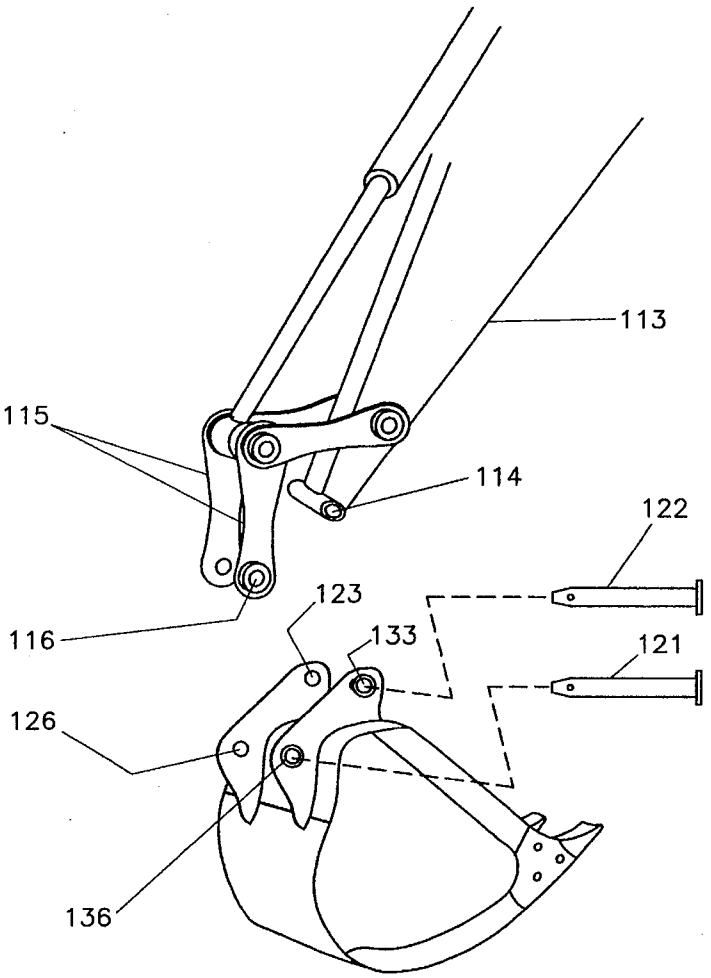
PRIOR ART FIG. 1a
FIG. 1*a* shows the equipment boom and implement separately.

To understand the present invention and its advantages it is necessary to appreciate in more detail, existing, commercial coupling methods and their deficiencies. FIG. 1 represents the connecting portion of a hoe boom on a typical earth-working machine and the associated connecting means on the implement. FIG. 1*a* shows the boom and the implement unattached and FIG. 1*b* shows them in their attached position. The boom typically consists of lift arm 113 and curling linkage 115. The "curling linkage" mechanism can consist of either two idler links and a power link, or a single part functioning as an idler link interacting with power link, either alternative being powered by hydraulic cylinder(s) and fitted for a link pin. The implement 120 has a distal end which includes a generally rectangular housing 130, formed by the implement's flanges or "ears". The housing is wide enough to permit entry of the lift arm 113 and the curling linkage 115. It also contains holes 133, 123, 136 and 126, which cooperate with holes 114 and 116 in the lift arm and curling linkage, respectively. Hinge pin 122 is passed through hole 133, bushing 114 and hole 123, and link pin 121 is passed through hole 136, bushing 116 and hole 126 to form the connection between boom and implement 120.

The connection has superficial simplicity. In fact however, it is difficult to effect the connection for the reasons mentioned previously. It not only takes a great amount of time and effort but is very dangerous as well. Some contractors have even resorted to "bucket clamps" in order to avoid removal of the bucket and the problems associated with driving pins in and out of the conventional connection. In general, "bucket clamps" refer to devices designed to slip over the tooth end of a bucket, clamp to the bucket lip or bottom, and often are furnished with hardware that wraps around or "grabs" other portions of the bucket. These clamps are an undesirable alternative because they apply unusual forces to both bucket and hoe boom in a manner different than that for which they were designed. Bucket clamps can easily damage bucket and boom and possibly void the manufacturer's warranty on these parts.

These disadvantages and others are obviated by the quick coupling device of the present invention. With reference to the preferred embodiment of this invention shown in FIGS. 2 through 4, the coupler comprises a housing 250, one portion of which may be attached to a boom and another portion of which may be attached to an implement. Although the boom and the implement are not shown, the pins which effect the connection between each of these and the coupler are illustrated. The "top" of the coupler is attached to the boom and the "bottom" of the coupler is attached to the implement as illustrated.

The quick coupler can be mounted to a boom using the hinge and link pins 122 and 121 (FIG. 1*a*), respectively, through holes 251 and 252 on the coupler (FIG. 2*a*) and holes 114 and 116 (FIG. 1*a*) on the boom. Although this connection has the same deficiencies as the connections utilized in the prior art, it is necessary to utilize this connection only once or, at least, very infrequently for the purpose of installing the quick coupler. Indeed, the quick coupler may be attached to the boom either temporarily or permanently in any manner that permits proper and secure operation of the equipment and implement. Once the coupler is installed, the implements of various manufacturers can be attached to the boom via a much more efficient manner utilizing the other side, i e., "bottom," of the quick connector.

The housing of the quick connector contains two sets of linking mechanisms—one for the hinge pin 222 and one for the link pin 271 (FIG. 2*b*) on the implement. The hinge pin mechanism, adjustable by screw 263, and the link pin mechanism, adjustable by turnbuckle body 277 and right hand and left hand rod ends 276 cooperate to form coupling means that are both quick and adjustable. As used herein "adjustable" means that the coupler can accommodate a range of spacings (or center-line distances) between holes on the implement for the hinge and link pins that are different from the fixed distance specified by the OEM of the earth-working equipment. In the preferred embodiment shown in FIGS. 2 through 4, the primary means for making the quick coupler adjustable is the means for moving the grab hook relative to the housing. Turnbuckle rod end linkage is primarily designed to "fine tune" the adjustment to compensate for wear of the parts and to define with respect to the housing where the locking lug will engage the link pin.

Of course, the device of the present invention can be used in situations where the holes on the implement conform to OEM equipment standards. However, it is the only coupling device which can not only make the full range of adjustments necessary to accommodate the large centerline differences in pin spacings on various implements, but can also adjust for pin and bushing wear, tightly grip the pins and keep the implement securely attached.

The hinge pin mechanism contains a "grab hook" assembly 261 to contact and engage hinge pin 222 for connection to the corresponding portion of an implement. The grab hook assembly depicted in the drawings comprises two hooks joined together by three cross members. The grab hook assembly pivots around a pin 262 attached to the sides of the housing 250. As described below, the hinge pin mechanism also contains adjustment means which moves the position of the grab hook when the coupler is engaged with the implement so that the coupler can accommodate various pin spacings in an implement. A preliminary adjustment for spacing differences can also be made prior to the first connection.

Figure 2A:
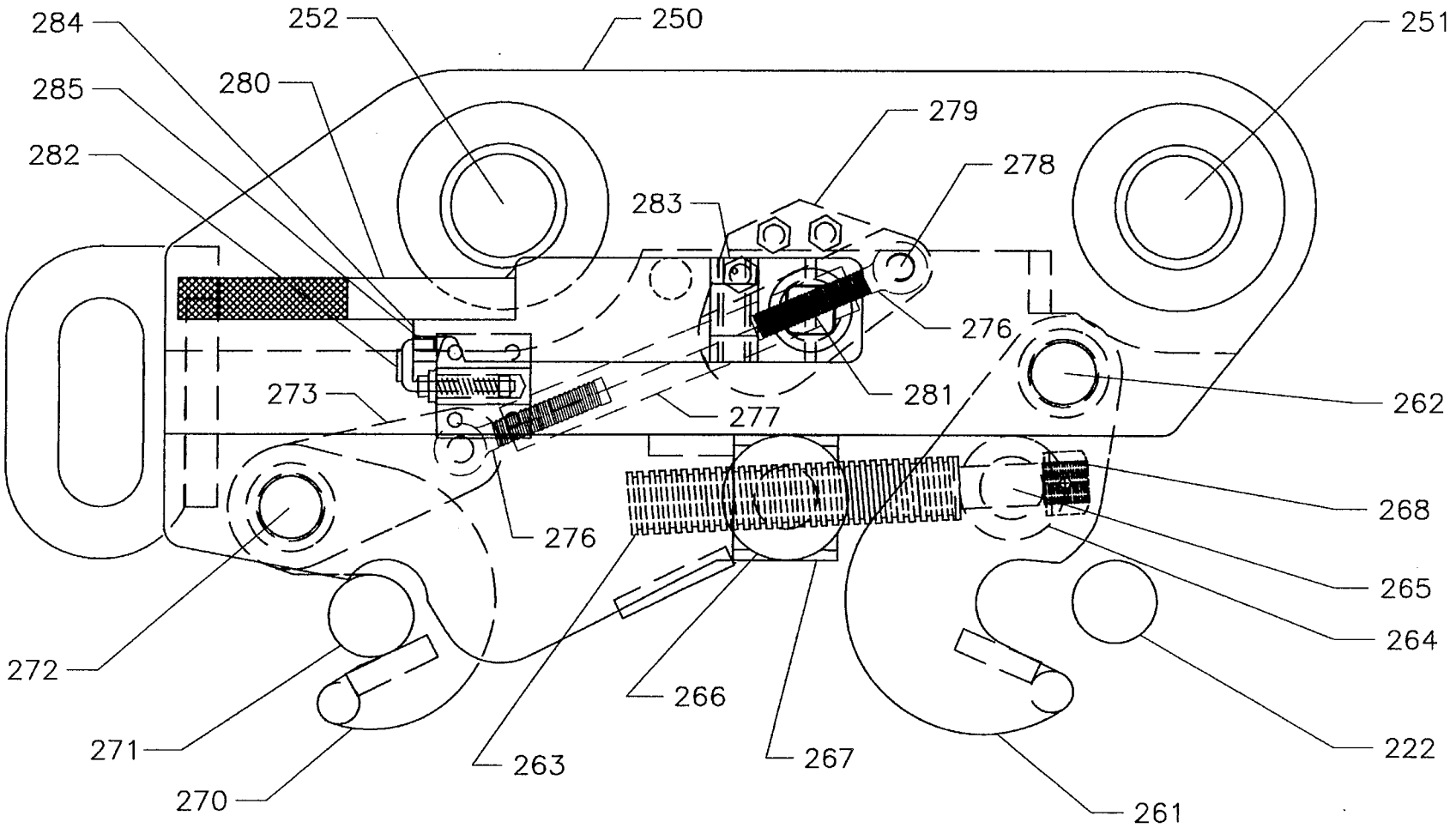
FIG. 2*a, b* and *c* all are side views of the preferred embodiment of the quick coupler of this invention, the only difference being in the adjustment to accommodate different implement pin spacings and whether the locking lug is in an open or closed position.
Figure 2B:
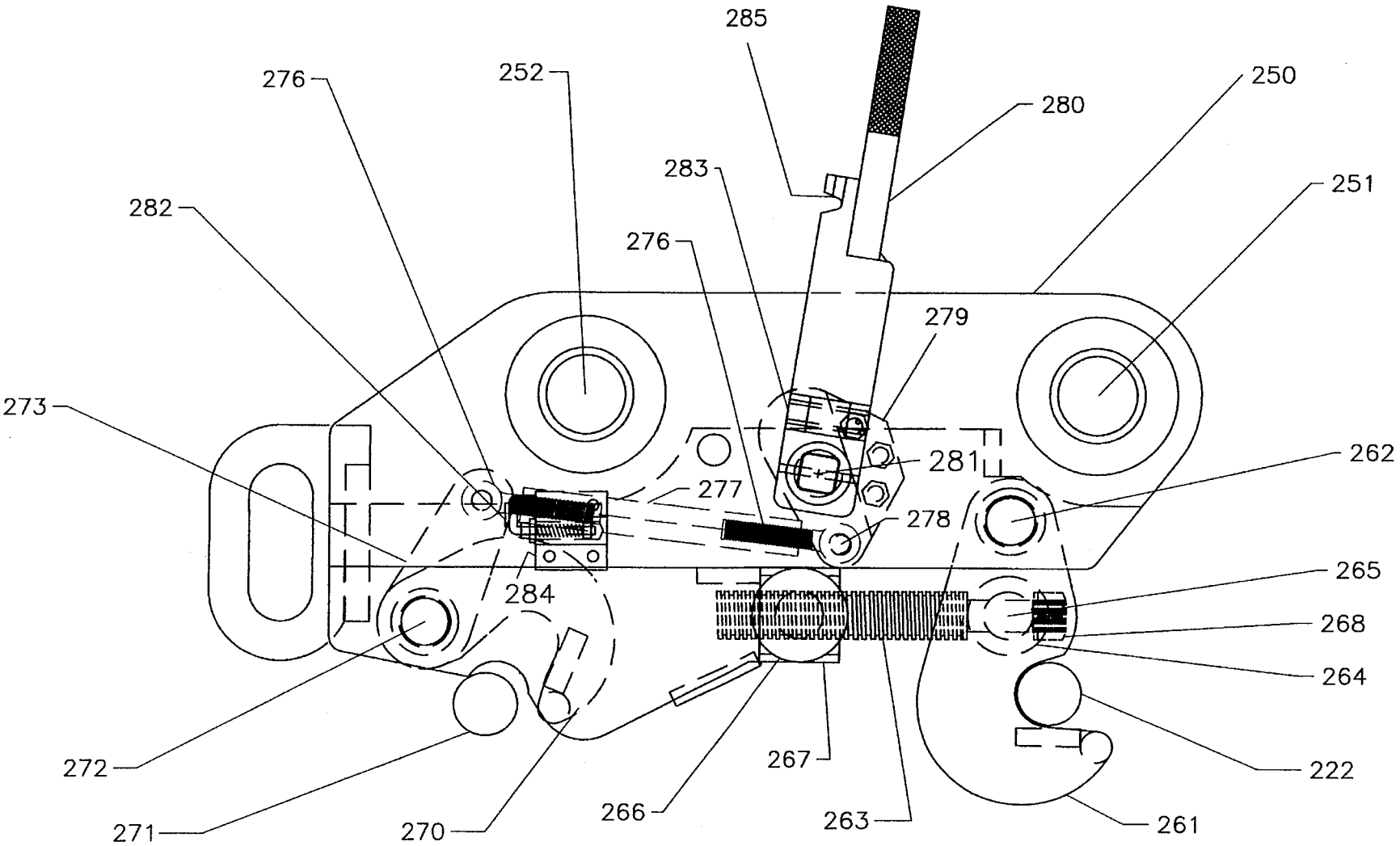
FIG. 2*b* is a side view of the preferred embodiment of the quick coupler with the adjustable grab hook pivoting about an axis, the handle and locking lug in the unlocked position, and the implement pins in a median position. It is preferable that this position most closely conforms to the pin spacing recommended or specified by the OEM of the earth-working device.
Figure 2C:
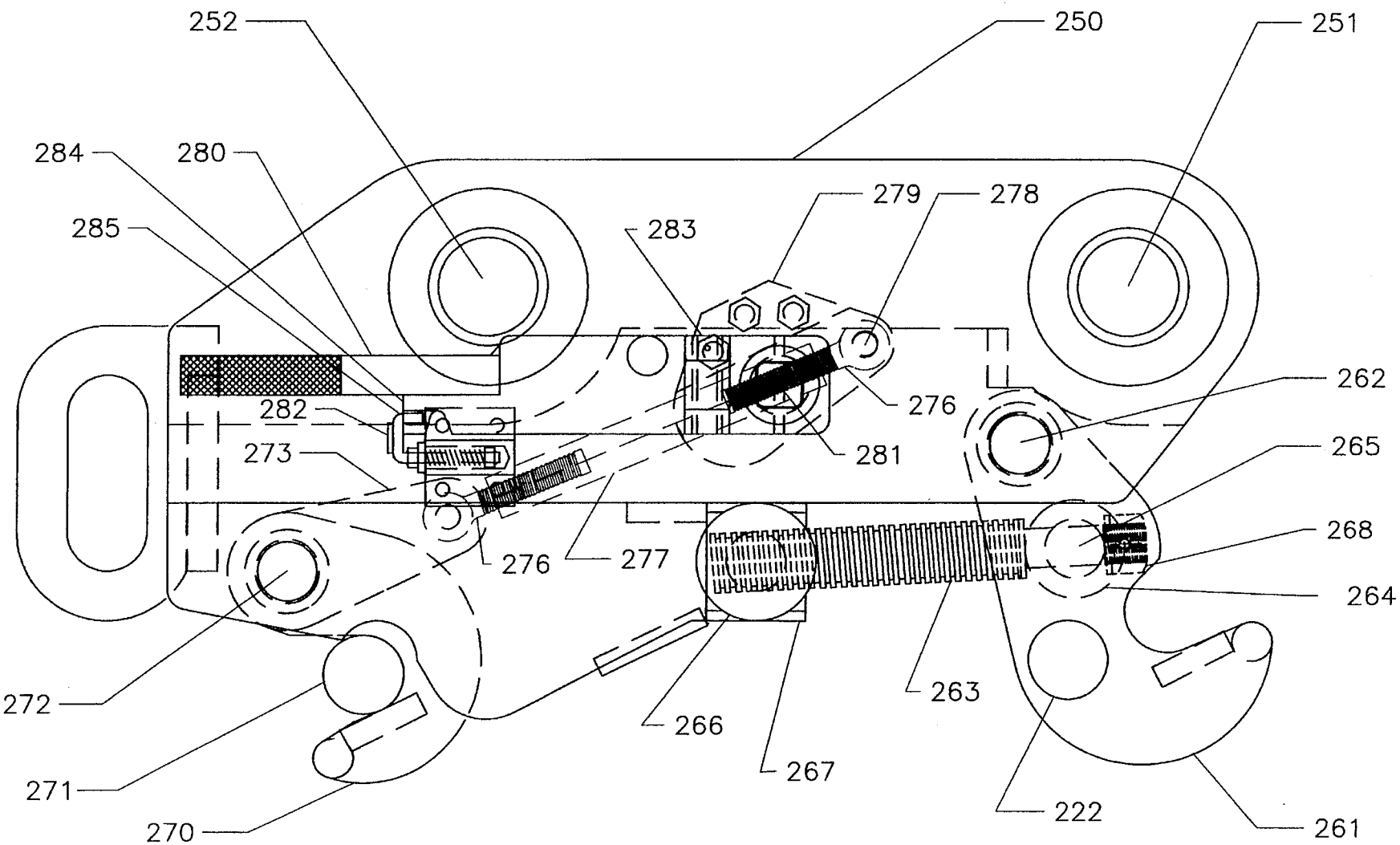
FIG. 2*c* is a side view of the preferred embodiment of the coupler with the adjustable grab hook pivoting about an axis, handle and locking lug in the locked position, and the implement pins spaced at the greatest distance from each other for which the coupler would be effective.

Link pin mechanism contains a "locking lug" 270 to contact and engage link pin 271 for connection to the corresponding portion of an implement. The locking lug pivots around a pivot point, comprising pin 272 also attached to the sides of the housing 250. The locking lug basically has two positions. The first, as illustrated in FIG. 2*b*, is an open position in which the lug is pulled back into the housing to receive entry of the link pin 271. The second, as illustrated in FIGS. 2*a* and 2*c*, is in a closed position in which the housing 250 and the locking lug 270 cooperate to close around the link pin 271 and, with the assistance of pressure, to hold it in place. The locking lug is moved between these two positions by an over-center locking device or cam mechanism.

The over-center or cam locking mechanism is activated by handle 280 on the exterior of the housing 250. Handle 280 pivots around pin 283 in a horizontal plane from a position in which it is parallel to the length of the housing 250 and resting against it, to a position away from the housing in which it may be grasped and rotated thereafter in a vertical plane by the hand of the user as described below. The first of these positions is illustrated in FIGS. 2*a* and 2*c* in which the locking mechanism locks the lug 270 against pin 271. The handle 280 may be secured in this position by a spring pin 282 housed in a bracket 284 with a hole in it that is attached to housing 250 and slipping into a matching hole 285 in the handle 280. The second position is illustrated in FIG. 2*b*, in which the spring pin has been disengaged from the handle, the handle moved away from the housing out of the drawing toward the reader a distance sufficient so that the handle can be grasped by a hand without interference from the housing, but allowing sufficient leverage to be applied to rotate the handle in the manner described in the next paragraph to the position shown in FIG. 2*b*.

The handle 280 pivots around pin 283 so that it can be moved away from the housing enough to get a good grip on it. The handle also pivots around pin 281 in a vertical plane to rotate the cam 279 which, in turn, activates the locking lug assembly. Locking lug assembly comprises two hooks or lugs joined together by three cross members. When the handle is moved clockwise from the position shown in FIGS. 2*a* and 2*c*, to the position shown in FIG. 2*b*, it retracts locking lug assembly 270 into the housing 250 so that it can receive pin 271. The handle is maintained in that position until the pin 271 swings into the recess in the housing which places the pin in the proper position to be secured by the locking lug assembly. The locking lug is activated by rotating the handle 280 counterclockwise back to the position shown in FIGS. 2*a* and 2*c*, where it is again secured to the housing.

The handle 280 is connected to the locking lug assembly 270 through a series of rods and pivots positioned within the housing 250. This includes two ears 273 which are attached to and are a part of the locking lug assembly 270, right-hand and left-hand threaded rod ends 276, and a turnbuckle body 277. One of the rod ends 276 is in turn connected at pivot point 278 to over-center locking mechanism comprising a cam assembly 279 which pivots about pin 281 when handle 280 is rotated.

As noted previously, the hinge pin mechanism also contains means to adjust the position at which the grab hook assembly 261 engages the hinge pin 222, thereby making the coupler adjustable for different spacings or centerline distances between the hinge and link pins. This adjustment is accomplished through an adjustment screw 263, which passes through and is trapped in a retaining block 264 which swivels in the grab hook assembly 261 about a point 265. In addition, the adjustment screw passes through an acme nut 266, which swivels in an two adjustment nut bearings 267 attached to the housing 250 to accommodate a change in the angle of the screw as the distance between retaining block 264 and acme nut 266 increases or decreases. A hexagonal nut 268 affixed to the end of the screw enables the user to vary the distance between the retaining block and the acme nut and, therefore, the position of the grab hook. In FIG. 2*c*, for example, the distance has been extended to its furthest point resulting in a maximum distance between the grab hook 261 and the locking lug 270. Variations in the centerline distance between hinge and link pins of 5 inches or more can be achieved using this adjustment on the grab hook.

The method of utilizing the coupler of the present invention is a simple one. The "top" of the coupler is attached directly to the hinge and curling linkage of the boom using the OEM pins that come with the machine. The coupler is designed to then "grab" standard pins left in the implement, and it is adjustable enough to accommodate a reasonable range of different pin spacings utilizing the sequence described below. It is significant that it is not necessary to align any holes on the boom with those on the implement. Instead, the hinge and link pins 122 and 121 are placed through the respective holes 123 and 133 and 126 and 136 on the implement. The quick connector is then attached to the pins as follows:

First, the spring pin 282 is disengaged from the hole 285 in the handle 28 and the handle and locking lever 280 is rotated clockwise into the upright position until the locking lug is retracted into the housing 250. The coupler is now in a position to receive the pins that have been left in the implement.

Using the curling linkage of the boom, the coupler is uncurled so that the grab hook is facing downward and in position to reach down between the "ears" on the implement to "grab" the hinge pin 222 left in the implement. As the coupler is lowered into the implement, the grab hook assembly engages the hinge pin. By curling the coupler and raising the boom, the implement is lifted off the ground. At this point, the implement can swing free by its hinge pin 222 which is cradled in the grab hook assembly 261 of the coupler. The curling motion is continued until the link pin 271 of the implement comes to rest in the recess in the coupler housing 250 designed to position the link pin for engagement of the locking lug assembly 270.

The link pin is then engaged with the locking lug assembly by rotating the handle/locking lever 280 counterclockwise until the lever can be secured to the coupler housing 250, again with the spring pin.

A wrench is used on the hexagonal nut 268 to adjust the locking lug assembly until it is snug against the link pin. This adjusting screw need only be utilized the first time that the coupler is used to connect an implement with a particular pin centerline distance and each time the coupler is used to attach an implement having a different centerline distance between pins.

At this time, it is desirable to repeat the first step, i.e., retracting the locking lug assembly from the link pin.

The hexagonal nut 268 on the grab hook assembly is then turned another one-quarter turn in the counter-clockwise direction. This adjustment puts enough pressure on both the hinge and link pins to hold the implement firmly in place. After the hexagonal nut and screw have been turned the additional one-quarter turn, the handle (lever) 280 is again turned counterclockwise to extend the locking lug assembly 270 against the link pin 271. The handle is secured to the housing with the spring pin 282 and the implement is ready for use.

Note that the grab hook assembly and the turnbuckle body of the over-center locking device should be set initially so that the locking lug makes contact with the link pin ⅛" to ¼" beyond the coupler frame in the direction of the link pin.

The specific embodiment that has just been described illustrates the advantages of the present invention. First, the connection process is quick and simple. It takes less than one minute to pick up and secure an implement. It is not necessary to attempt to align any pin holes. The process is safe and the chance of any injuries whatsoever should be minimized.

Second, the coupler is adjustable. It accommodates a range of pin spacings or centerline distances. It is always snug and secure even after some pin or bushing wear has taken place.

Third, there is a positive mechanical locking mechanism which is directly manipulated by the operator. Although the operator must alight from the cab or use the assistance of another person to complete the connection between the boom and the implement, the operator can always know when he has the implement securely in place.

Fourth, the device creates a tensioning force on the hinge and link pins. This tension comprises equal and opposite forces applied to the hinge pin and the link pins along the centerline between them and in a direction outward from each end of the housing and in opposite directions with respect to each of these pins.

The foregoing generally describes the features of one preferred embodiment of our invention. It is anticipated that the principles of the invention may be embodied in other specific forms. For example, the specific device shown herein has the means for adjusting the spacing between the locking lug and the grab hook associated with the hinge pin mechanism, which pivots about a shaft through the housing. This could be reversed so that the means for adjusting the spacing is associated with the link pin mechanism.

Figure 5:
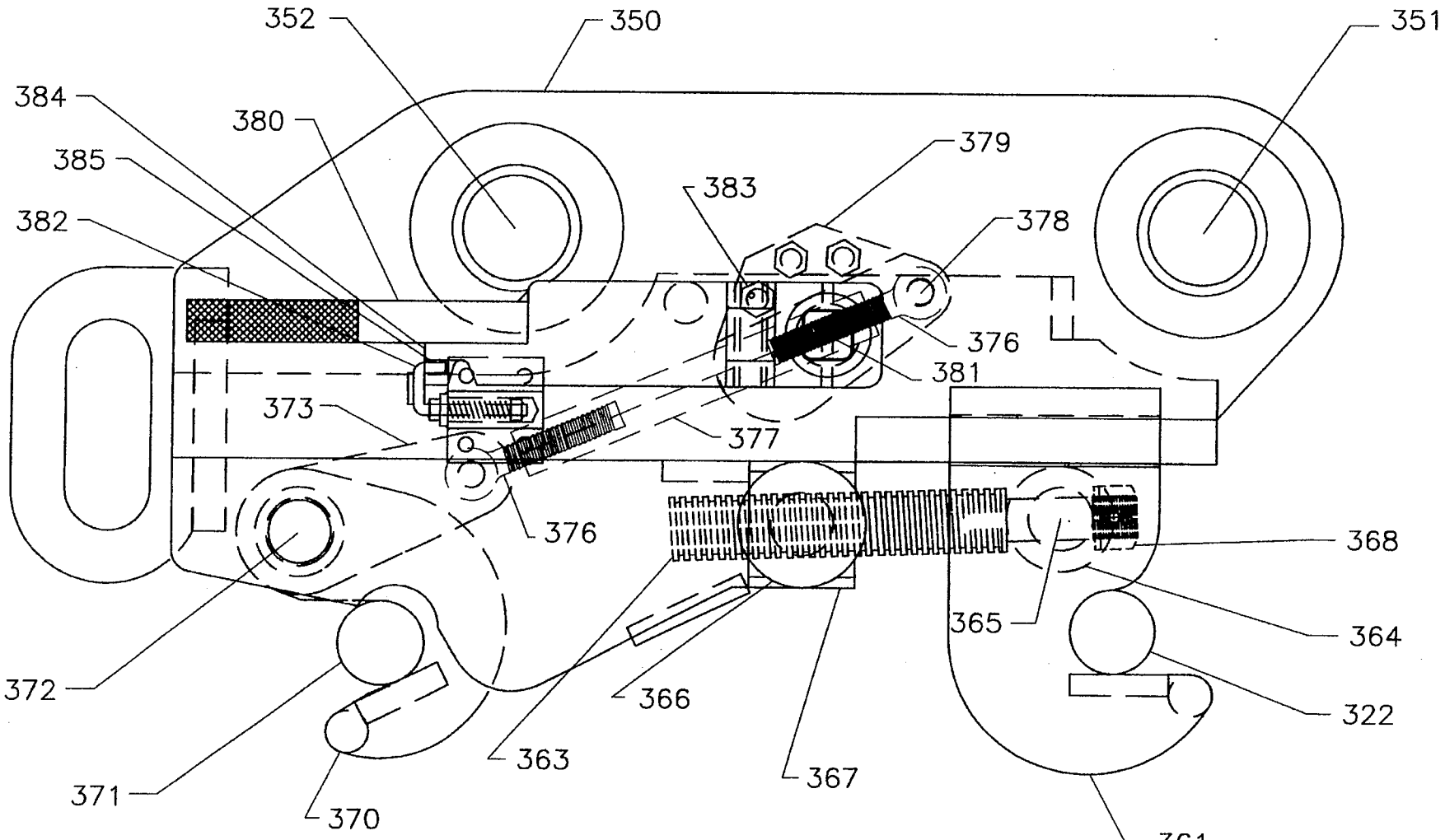
FIG. 5 is a side view of an alternative embodiment showing a different configuration for adjusting the grab hook. This embodiment has a grab hook assembly that can slide between tracks or "ways" built into the housing. The forward and backward movement of the grab hook assembly is effected by turning the adjusting screw one way or the other. The coupler is shown in this view with handle and locking lug in the locked position and the implement pins in their most frequently used, i.e., median location with respect to each other.
Figure 6:
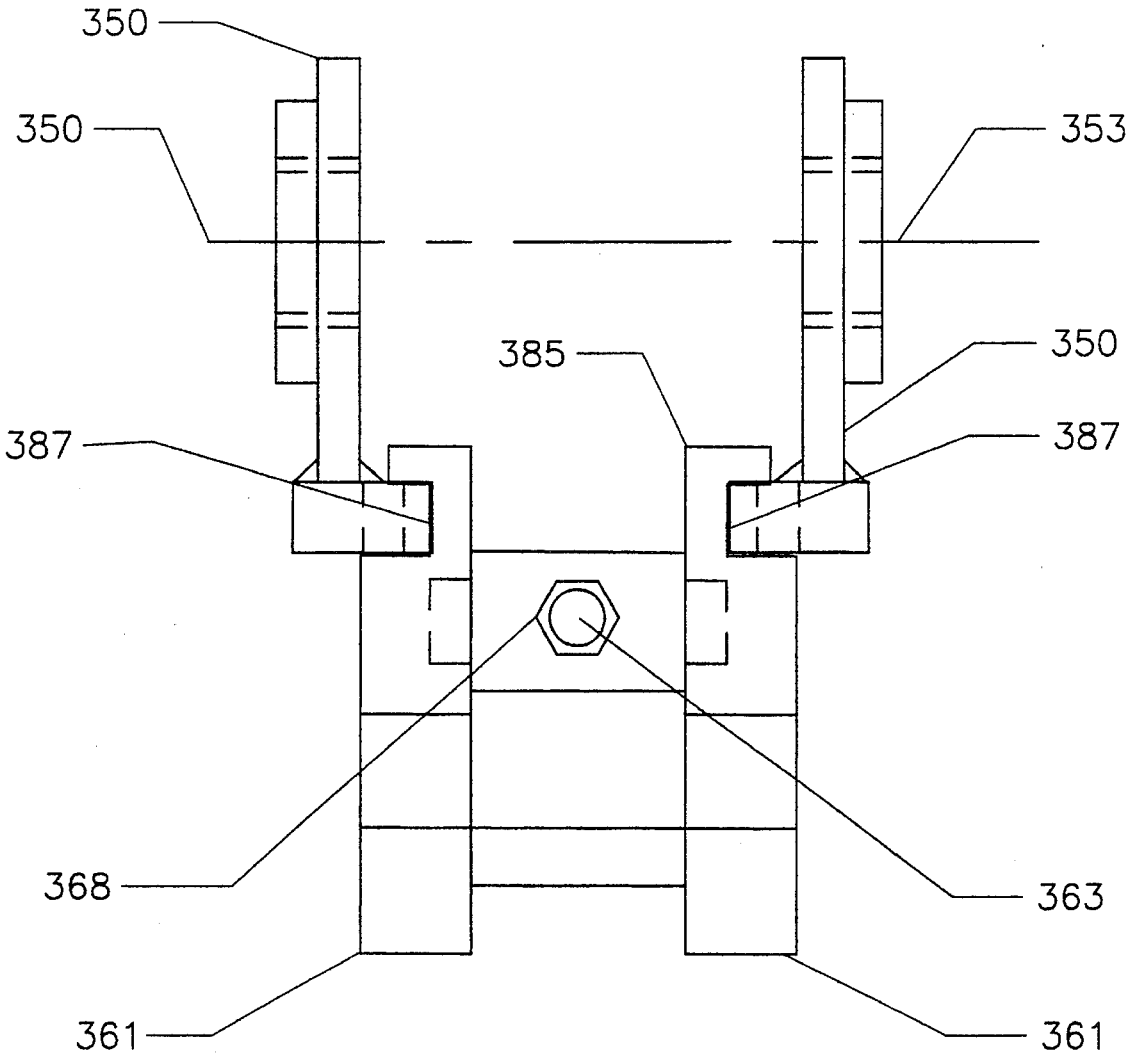
FIG. 6 is an end view of the coupler shown in FIG. 4, having the aforementioned alternative means of effecting an adjustable grab hook.

An alternative means of accomplishing pin spacing adjustment has been illustrated in FIGS. 5 and 6. The grab hook assembly in this illustration, instead of pivoting about a point as the adjustment screw is turned, slides back and forth between a set of tracks or ways built into the housing. This adjustment is accomplished through an adjustment screw 363, which passes through a hole in a retaining block 364 of the grab hook assembly 361. The adjustment screw 363 passes through a threaded hole in the adjustment nut 366, which is allowed to swivel in housing 350. A hexagonal nut 368 affixed to the end of the screw enables the user to vary the distance between the retaining block 364 and the adjustment nut 366. When the screw is turned, the grab hook assembly slides back and forth between a set of tracks or ways 387 built into the housing 350. It may also be possible to associate this adjustment means with the link pin mechanism instead of the hinge pin mechanism or the adjustment means may be associated with both the hinge and link pin mechanisms. In addition, the shape and configuration of the grab hook and locking lug may be changed or may be substituted by a different configuration (i.e., wedges or pins) to accommodate other possible alternative mating portions of the implement. These and other changes are within the spirit of this invention.

We claim:

1. A quick coupling device for detachably attaching an implement to a piece of earth-working equipment which is provided with a boom comprising a lift arm and a curling linkage, wherein the implement contains coupling means consisting of a hinge pin and a link pin, said coupling device comprising:

a housing;

means on the housing for attaching the coupling device to the boom of the earth-working equipment;

means on the housing for attaching the coupling device to the implement including:

means for attaching the coupling device to the hinge pin; and means for attaching the coupling device to the link pin including:

a locking lug for engagement with the link pin; and a locking device capable of interacting with the locking lug to move the locking lug between an open position and a closed position and to lock the locking lug in the closed position wherein the means for attaching the coupling device to the hinge pin and the means for attaching the coupling device to the link pin are separated from one another by an effective distance; and means for adjusting the effective distance between the means for attaching the coupling device to the hinge pin and the means for attaching the coupling device to the link pin so that the quick coupling device can be used with various implements having different centerline distances between hinge pin and link pin.

2. The quick coupling device of claim 1 in which the means for adjusting the effective distance between the means for attaching the coupling device to the hinge pin and the means for attaching the coupling device to the link pin comprise means for moving the means for attaching the coupling device to the hinge pin closer to or farther away from the means for attaching the coupling device to the link pin.

3. The quick coupling device of claim 2 wherein the means for attaching the coupling device to the hinge pin and the means for attaching the coupling device to the link pin cooperate in a manner which creates tension on both the hinge pin and link pin in a direction along the center line between the hinge and link pins and outward from the housing with respect to each of these pins.

4. The quick coupling device of claim 2 wherein the quick coupling device is attached to the lift arm and the curling linkage of the earth-working equipment using a second hinge pin and a second link pin.

5. The quick coupling device of claim 3 wherein the means for attaching the coupling device to the link pin contains further means for adjusting the amount of tension placed on the hinge pin and the link pin.

6. The quick coupling device of claim 2 wherein the locking device comprises a cam mounted for rotation about an axle substantially parallel to the link and hinge pins and a linkage comprising a series of rods and pivots connecting the cam to the locking lug, said cam and linkage cooperating to move the locking lug between an open and a closed position, said cam being over-center with respect to said axle when the locking lug is in the closed position to lock the lug in that position.

7. The quick coupling device of claim 2 wherein the means for attaching the coupling device to the hinge pin of the implement includes at least one "hook" shaped grab hook.

8. The quick coupling device of claim 7 wherein the grab hook is rotatably attached to the housing and the means for adjusting the effective distance between the means for attaching the coupling device to the hinge pin and the means for attaching the coupling device to the link pin includes threaded connection means attaching the grab hook to a pivot attached inside the housing so that movement of the threaded connection moves the grab hook relative to the housing and rotates said pivot to accommodate realignment of the grab hook with the housing as the grab hook rotates.

9. The quick coupling device of claim 7 wherein the grab hook is attached to a slide movable within parallel grooves on the inside of each side of the housing, and the means for adjusting the effective distance between the means for attaching the coupling device to the hinge pin and the means for attaching the coupling device to the link pin includes threaded connection means attaching the slide to a threaded hole located between the grooves so that movement of the threaded connection moves the grab hook relative to the housing.

10. The quick coupling device of claim 2 wherein the means for attaching the coupling device to the link pin of the implement comprises at least one "hook" shaped locking lug.

11. A method for quickly attaching an implement to a piece of earth-working equipment which is provided with a boom comprising a lift arm and a curling linkage, wherein the implement contains coupling means consisting of a hinge pin and a link pin separated in distance from one another comprising:

attaching a quick coupling device to the lift arm and curling linkage of the earth-working equipment, said quick coupling device containing a hook to engage the hinge pin of the means to move the lug relative to the quick coupling device to engage the link pin;

adjusting the distance between the hook and lug of the quick coupling device to accommodate the distance between the hinge pin and the link pin of the implement using means for adjusting the distance between the hook and lug, independent of the means for moving the lug, for mutual engagement of the hinge and link pins and;

attaching the quick coupling device to the hinge pin of the implement;

raising the boom to "curl" the implement, thereby aligning the quick coupling device with the link pin on the implement;

attaching the quick coupling device to the link pin of the implement by using the means for moving the lug to engage the link pin; and adjusting the quick coupling device so that it creates tension on both the hinge pin and link pin in a direction along the center line between the hinge and link pins and outward from the housing with respect to each of these pins using said means for adjusting the distance between the hook and lug, independent of the means for moving the lug, for mutual engagement of the hinge and link pins.

12. The method of claim 11 which includes the additional step of locking the quick coupling device to the implement.

* * * * *